US011692319B2

(12) United States Patent
Doy

(10) Patent No.: US 11,692,319 B2
(45) Date of Patent: Jul. 4, 2023

(54) DYNAMIC IMAGE AUGMENTATION FOR MILLING MACHINE

(71) Applicant: Caterpillar Paving Products Inc., Brooklyn Park, MN (US)

(72) Inventor: Nathaniel S. Doy, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 544 days.

(21) Appl. No.: 16/829,819

(22) Filed: Mar. 25, 2020

(65) Prior Publication Data

US 2021/0299807 A1 Sep. 30, 2021

(51) Int. Cl.
*E01C 23/088* (2006.01)

(52) U.S. Cl.
CPC ..... *E01C 23/088* (2013.01)

(58) Field of Classification Search
CPC ..... E01C 23/088
See application file for complete search history.

(56) References Cited

U.S. PATENT DOCUMENTS

| | | | | |
|---|---|---|---|---|
| 9,797,100 | B1 * | 10/2017 | Muir | E01C 23/065 |
| 10,041,215 | B2 | 8/2018 | Muir et al. | |
| 10,233,598 | B2 * | 3/2019 | Lee | E01C 23/088 |
| 10,273,642 | B2 | 4/2019 | Berning et al. | |
| 10,344,435 | B2 | 7/2019 | Berning et al. | |
| 10,543,782 | B2 * | 1/2020 | Laclef | E01C 23/088 |
| 10,633,806 | B2 * | 4/2020 | Sondreal | E01C 23/088 |
| 2018/0061040 | A1 | 3/2018 | Beery et al. | |
| 2018/0340302 | A1 | 11/2018 | Menzenbach et al. | |
| 2019/0210525 | A1 | 7/2019 | Laclef et al. | |

FOREIGN PATENT DOCUMENTS

JP 2006-112127 A 4/2006

OTHER PUBLICATIONS

Entry "equation of motion (kinematic equation)" from A Dictionary of Physics (8 ed.) Edited by: Richard Rennie and Jonathan Law. accessed from oxfordreference.com (Year: 2019).*

* cited by examiner

*Primary Examiner* — Janine M Kreck
(74) *Attorney, Agent, or Firm* — Leydig, Voit & Mayer, Ltd.

(57) ABSTRACT

A machine for milling pavement such as a rotary mixer or road planer includes a cutting rotor that is vertically adjustable with respect to the frame and that is accommodated in a rotor enclosure. The milling machine may be associated with a visual camera network having one or more cameras located about the milling machine with a field of view toward the rotor enclosure and work surface. An image augmentation system can generate a reference line augmentation to superimpose over one or more visual images obtained by the cameras and display the augmented images on a visual display.

16 Claims, 5 Drawing Sheets

DYNAMIC IMAGE AUGMENTATION FOR MILLING MACHINE

TECHNICAL FIELD

This patent disclosure relates generally to a machine for milling a work surface such as a rotary mixer or road planer equipped with a cutting rotor and, more particularly, to an imaging system to assist in operation of the milling machine.

BACKGROUND

There exist various machines for removing or milling matter such as pavement, asphalt, or concrete from a work surface such as a roadway or similar surfaces. For example, rotary mixers and road planers typically include a cylindrical rotating drum or cutting rotor supported on a frame that in turn is supported on a plurality of ground engaging traction devices like wheels or continuous tracks. Further, the cutting rotor may be vertically adjustable with respect to the work surface. As the milling machine travels over the work surface, the cutting rotor is lowered into the work surface and a plurality of teeth-like 130 or picks disposed about the cylindrical surface of the cutting rotor can penetrate into, fragment, and break apart the top layer of the surface.

To contain the fragmented debris generated by the milling process and prevent it from dispersing around the milling machine, the cutting rotor is typically accommodated in a rotor enclosure, which may visually obstruct some or all of the cutting rotor. In addition, because of the size of the milling machines, the operator station may not be located to provide the most advantageous views about the milling machine. Accordingly, in some cases, milling operations may be conducted with individuals walking alongside the milling machine to observe the milling operation and relay those observations to the machine operator.

U.S. Patent Publication No. 2019/0210525 (the '525 publication), titled "Cutting Tool Visual Trajectory Representation System and Method," describes using one or more cameras located on a milling machine to facilitate the milling operation by increasing visibility about the machine. The images captured by the cameras can be presented on a visual display screen accessible to the operator. Moreover, the '525 publication describes a computer implemented imaging processing system that can enhance the images presented on the display screen. The present disclosure is directed to an improved system and method for capturing, augmenting, and presenting a visual image for operator assistance during a milling operation.

SUMMARY

The disclosure describes, in one aspect, a milling machine for milling a work surface like a roadway covered in asphalt or pavement. The milling machine includes a frame supported on a plurality of traction devices for travel along the work surface along a travel axis. The frame includes a first lateral side and a second lateral side aligned with a travel axis of the milling machine. A cutting rotor is rotatably supported on the frame for milling a work surface and is shaped a cylindrical drum with a rotor axis perpendicular to the travel axis. To accommodate the cutting rotor, a rotor enclosure is located on the frame and includes a first enclosure sidewall aligned with the first lateral side and a second enclosure sidewall aligned with the second lateral side. To capture an image of the rotor enclosure and the work surface, a camera may be supported on the frame at one of the first and/or second lateral sides. The milling machine may also include an electronic controller programmed to receive the visual image from the camera; determine positions for one or more lateral contact lines of the cutting rotor with respect to the work surface; generate a reference line augmentation corresponding to the lateral contact lines; and superimpose the reference line augmentation on the visual image to create an augmented image.

In another aspect, the disclosure describes a method of operating a milling machine for milling a work surface like a roadway covered in asphalt or pavement. The method includes capturing a visual image including both the lateral side of a rotor enclosure that houses a cutting rotor and of the work surface. The method determines the location of one or more lateral contact lines where the cutting rotor will contact the work surface and generates a reference line augmentation corresponding to the lateral contact lines. The reference line augmentation is superimposed on the visual image to create an augmented image that can be displayed on a visual display associated with the milling machine, In yet another aspect of the disclosure, there is described a control system for a milling machine having a cutting rotor for milling a work surface. The control system includes a first camera to capture a first visual image of a first lateral side of the milling machine and a second camera to capture a second visual image of a second lateral side of the milling machine. The control system also includes an electronic controller configured to determine one or more lateral contact lines where the cutting rotor will contact the work surface, generate a reference line augmentation corresponding to the lateral contact lines, and superimpose the reference line augmentation on the first visual image to generate a first augmented image and on the second visual image to generate a second visual image. The control system is operably associated with a visual display to display the first augmented image and the second augmented image in a side-by-side relation.

DETAILED DESCRIPTION

Figure 1:
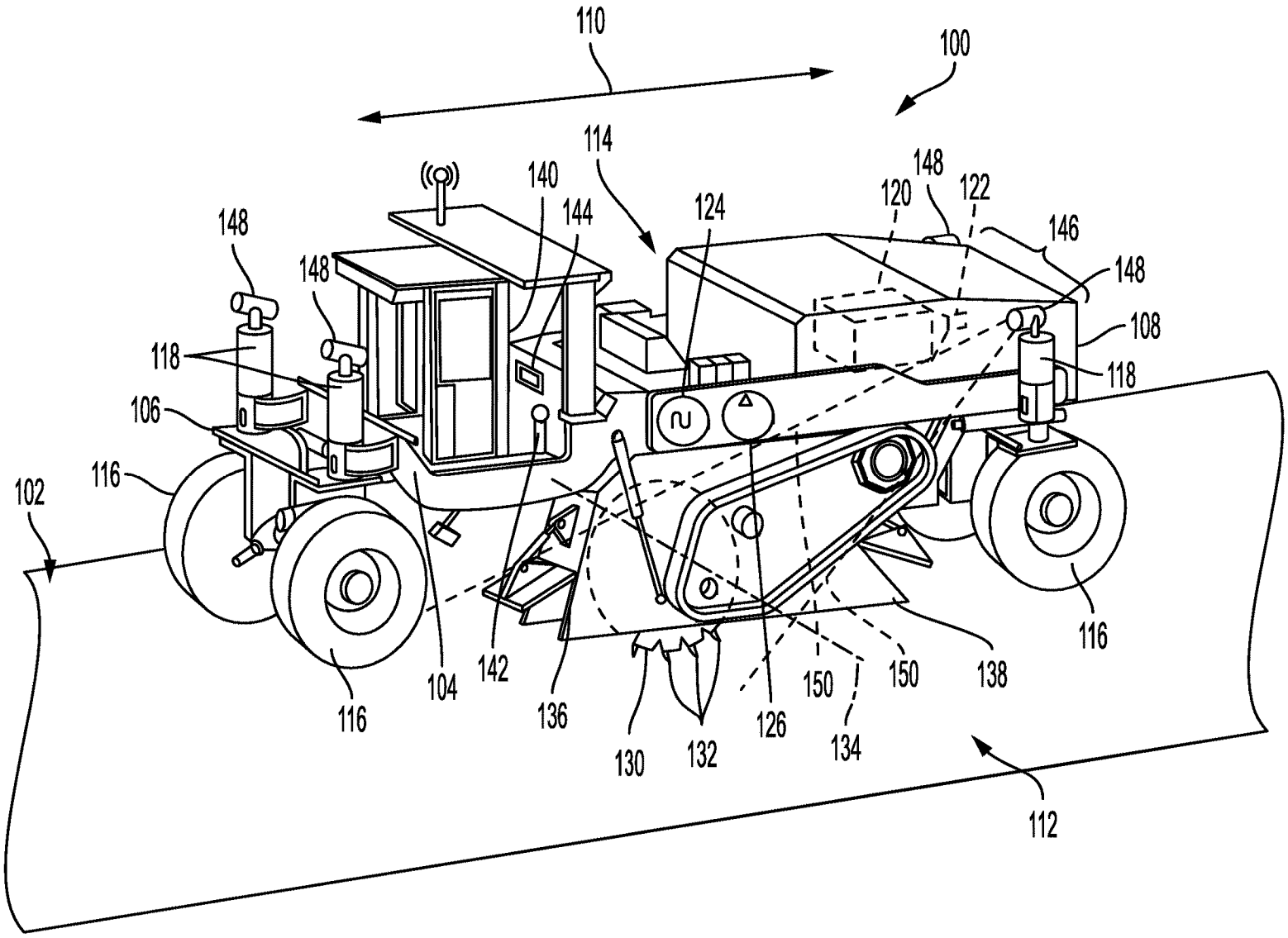
FIG. 1 is a perspective image of a milling machine for milling a work surface equipped with a cutting rotor accommodated in a rotor enclosure and a plurality of cameras to capture a visual image of the milling machine and work surface.

Now referring to the drawings, wherein whenever possible like reference numbers refer to like features, there is illustrated in FIG. 1 a machine in the particular embodiment of a rotary mixer 100 that, as familiar to those of skill in the art, are utilized in road repair and repaving operations. Rotary mixers 100 are configured to remove and reclaim or reuse a layer of a work surface 102 such as pavement, concrete, asphalt, or other material by penetrating into and fracturing the work surface in a milling operation. The fractured material may be redeposited on the work surface 102 where it can be used as a foundation or base aggregate in a subsequent paving operation. In addition to rotary mixers, the present disclosure is applicable to other milling machines such as road planers that can mill and remove a layer of the work surface, soil reclaimers for churning and relaying soil, and other machines used in work surface milling operations and similar operations in construction and agriculture.

The rotary mixer 100 can include a frame 104 that may be oriented with a forward end 106 and a rearward end 108 that are aligned along a travel axis 110 of the machine; however, because the rotary mixer 100 may operate in both forward and reverse directions, the designations are used herein for reference purposes. The frame 104 may also include a first lateral side 112 and an opposite second lateral side 114, which, depending upon the orientation of the observer, may corresponding to the left hand side or the right hand side of the rotary mixer. The first and second lateral sides 112, 114 are again used herein for reference and orientation purposes arbitrary.

To support the rotary mixer 100 on the work surface 102, the frame 104 can be suspended on a plurality of ground-engaging traction devices 116. In the illustrated embodiment, the traction devices 116 can be rotatable wheels that can include rubber pneumatic tires. The wheels may be designated as powered drive wheels to propel the rotary mixer 100, steerable wheels to adjust direction of the rotary mixer, or combinations thereof. Another suitable embodiment of traction devices 116 include continuous tracks such as a closed belt disposed about rollers and/or sprockets where translation of the belt carries the rotary mixer 100 over the work surface 102. To vertically raise and lower the rotary mixer 100 with respect to the work surface 102, the frame 104 can be coupled to the traction devices 116 by a plurality of lifting columns 118. The telescopic lifting column 118 can independently extend and retract to adjust the height, grade, and slope of the frame 104 relative to the work surface 102. In an embodiment, lifting columns 118 can be located at the forward end 106 and at the rearward end 108 to either lateral side 112, 114 so that the pitch, slope, and/or grade of the rotary mixer 100 can be selectively altered.

To power the traction devices 116, lifting columns 118, and other systems of the rotary mixer 100, a power source such as an internal combustion engine 120 can be disposed on the frame 104. The internal combustion engine 120 can burn a hydrocarbon-based fuel like diesel or gasoline and convert the latent chemical energy therein to a mechanical motive force in the form of rotary motion that can be harnessed for other useful work. The rotary output of the engine 120 can be transmitted through a crankshaft 122 extending from the engine and operatively coupled to the traction devices 116 and other systems. For example, the engine 120 can be operatively coupled to and drive other power systems on the rotary mixer such as an electrical generator 124 to generate electricity for an electrical system and a hydraulic pump 126 for pressurizing and directing hydraulic fluid for a hydraulic system.

To engage and fragment the work surface 102, the rotary mixer 100 can include a power driven cutting rotor 130 rotatably supported by the frame 104. The cutting rotor 130 can be a drum-shaped, cylindrical structure having a plurality of picks or teeth-like cutting tools 132 disposed about its cylindrical surface. As the cutting rotor 130 rotates, the cutting tools 132 impact and penetrate into the work surface 102 fracturing the material thereof. The cutting tools 132 are adapted to penetrate into the work surface 102 and remove a portion of the material as the rotary mixer 100 advances along the travel axis 110 through a process referred to as milling or planning. In some embodiments, the cutting tools 132 may be removable from the cutting rotor 130 for replacement as they become worn or damaged. The cutting rotor 130 can rotate about a rotor axis 134 that extends between the first and second lateral sides 112, 114 of the frame 104 and that is generally perpendicular to the travel axis 110.

To contain the fragmented material and debris, the cutting rotor 130 can be rotatably accommodated in a housing or rotor enclosure 136 that depends from the frame 104 toward the work surface 102. The rotor enclosure 136 can define an enclosed space for the cutting rotor 130 and can be formed of sheet metal or plate metal walls welded or fastened together, including an enclosure sidewall 138 aligned with the first lateral side 112 and another enclosure sidewall 138 aligned with the second lateral side 114. The rotor enclosure 136 and the cutting rotor 130 therein may extend across the lateral width of the rotary mixer 100. In the example of a rotary mixer used in work surface reclamation processes, the rotor enclosure 136 can function as a mixing chamber and can be operatively associated with other systems to receive water or other materials for mixing with the fragmented debris. When the cutting rotor 130 rotates in the rotor enclosure 136, the rotation mixes the fragments and materials that can be redeposited on the work surface 102. To drive rotation, the cutting rotor 130 can be operatively coupled to the engine 120 through a mechanical arrangement or it may be powered by the electrical generator 124 or hydraulic pump 126.

To accommodate an operator, an onboard operator station 140 can be support on the frame 104 in an elevated location to provide visibility about the worksite for carrying out the milling operation. The operator station 140 can include a variety of controls, readouts, and other input/output interfaces for monitoring and controlling operation of the rotary mixer 100. For example, to steer in the rotary mixer 100 and change its direction, a steering mechanism 142 such as a steering wheel or joystick, can be included in the operator station 140. Other operator controls can include pedals or levers to adjust the speed and/or forward-reverse directions of the rotary mixer 100. The operator station 140 may also include operator controls for regulating and adjusting operation of the cutting rotor 130, including parameters such as rotor speed, rotor elevation with respect to the work surface 102, and depth of cut into the work surface. To visually interact with the operator, the operator station 140 may include one or more visual displays 144 such as a liquid crystal display or similar viewing device. In other embodiments, the rotary mixer may 100 may be configured for remote operation and some or all of the foregoing operator controls and other input/output interfaces can be located remotely from the onboard operator station.

Even though the operator station 140 may be located in an evaluated position, visibility about the rotary mixer 100 may be limited or impeded by obstructions. For example, because the cutting rotor 130 is located in the rotor enclosure 136, interaction of the cutting rotor and work surface 102 is necessarily obscured. In addition, where the rotary mixer 100 is configured for remote operation, the operator may not be positioned for firsthand, direct visual observation of the work surface 102 and surrounding worksite. To assist the operator during the milling operation, the rotary mixer 100 can be operatively associated with a visual camera network 146 including a plurality of cameras 148 or image capturing devices mounted to the frame 104 or to another structure of the rotary mixer. The cameras 148 can be of any suitable construction and can utilize any suitable photographic technologies to capture a visual image. The cameras 148 may have pan, zoom, tilt and focus capabilities and may capture still images or video. In an embodiment, the cameras 148 can be digital video cameras that utilize an active pixel sensor embedded in a semiconductor material, although in other embodiments the cameras 148 may capture still images.

The cameras 148 can be disposed to provide a line of sight or field of view toward locations and areas not readily visually accessible to the operator. In accordance with an aspect of the disclosure, a first camera 148 may be disposed to provide a field of view along the first lateral side 112 of the frame 104 generally along the direction of the travel axis 110. For example, the camera 148 can be located on the first lateral side 112 and may be mounted on the lifting column 118 at the rearward end 108 of the frame 104 facing forward and downward. The arrangement of the camera 148 is such that the field of view, also referred to as the angle of view, includes the sidewall 138 of the rotor enclosure 136 and the work surface 102. The field of view refers to the dimensional and angular extension of the surrounding environment the camera 148 can capture as a visual image. The field of view may be determined by the construction of the camera 148 and the lenses thereon, for example wide-angled or fish eyed lens, and may be adjustable by zoom, pan, and tilt controls. In the illustrated embodiment, the field of view is indicated in dashed lines 150. To capture a similar field of view of the second lateral side 114, a second camera 148 can be located on the second lateral side at the rearward end 108 of the frame 104. In other embodiments, cameras 148 can be located on the forward end 106 of the frame 104 facing rearward, or at other suitable locations on the frame or other structure.

The visual images captured by the plurality of cameras 148 of the visual camera network 146 can be presented on the visual display 144 associated with the operator station 140. The operator can use the images of the possibly obscured locations on the rotary mixer 100 to monitor and make adjustments to the milling operation. In an embodiment, the visual images may be presented in real time so the operator can make timely adjustments during the milling operation as they are observed. The visual display 144 may include a selector switch to change between image feeds from the different cameras 148.

Figure 2:
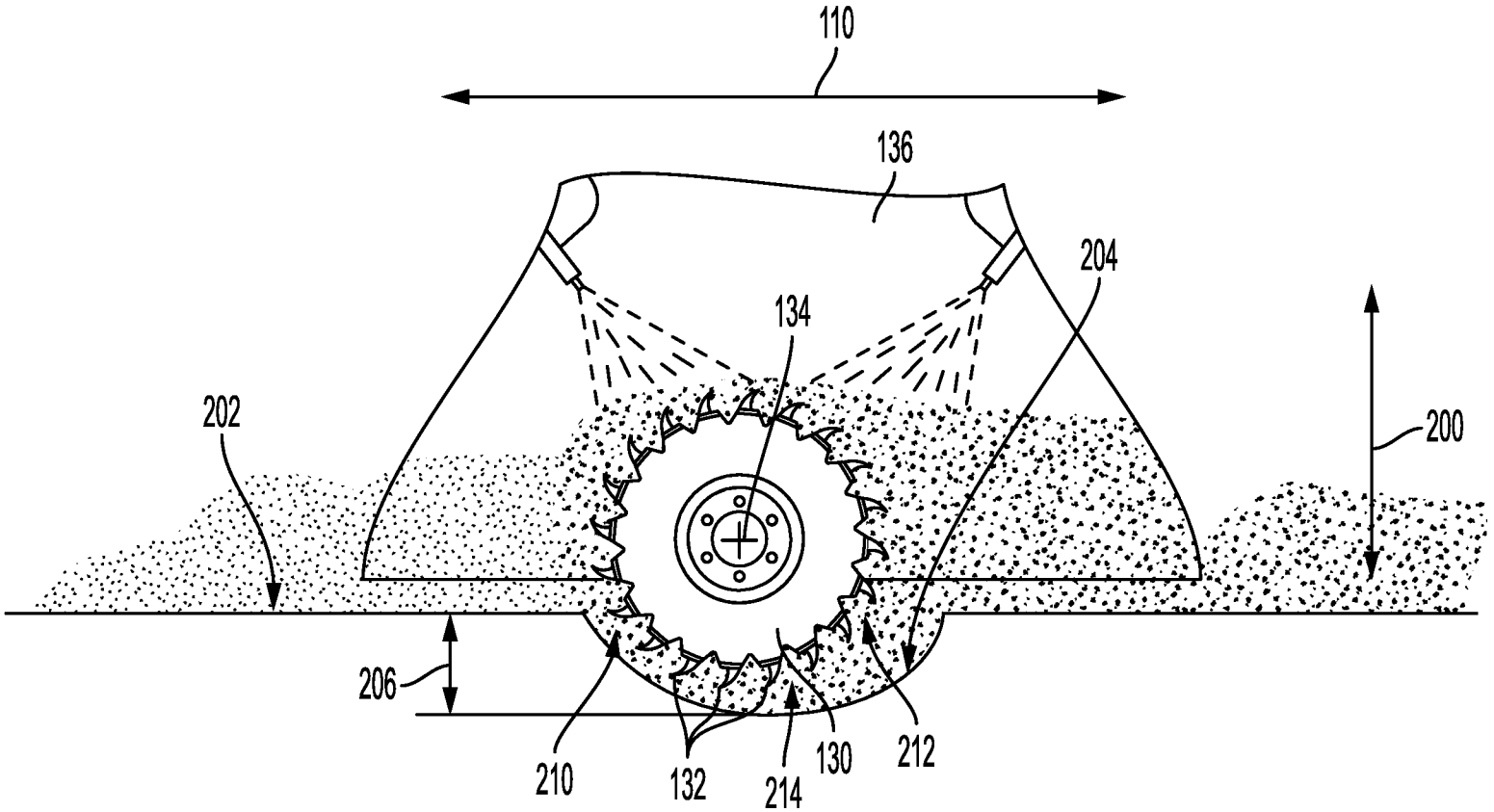
FIG. 2 is a schematic representation of the cutting rotor engaging the work surface by penetrating into the work surface to delineate one or more lateral contact positions between the cutting rotor and work surface.

Referring to FIG. 2, there is illustrated engagement of the cutting rotor 130 as accommodated in the rotor enclosure 136 with respect to the work surface 102 during a milling operation. The milling operation includes different relative elevations of the cutting rotor 130 and the work surface 102 with respect to a vertical axis 200. Initially, the cutting rotor 130 may be located vertically above the work surface 102 in a disengaged position with respect to an un-milled surface 202 of the work surface 102. To engage the work surface 102, the operator actuates an elevation mechanism operatively associated with the rotary mixer 100 to lower the cutting rotor 130 toward the work surface. The elevation mechanism may include the telescopic lifting columns 118 that couple the frame 104 to the traction devices 116, which utilize hydraulic pressure to adjust the elevation of the rotary mixer 100 with respect to the vertical axis 200. In other embodiments, the cutting rotor 130 may be independently moveable with respect to the frame 104 along the vertical axis 200. Prior to engagement, the cutting rotor 130 may be activated so that it rotates with respect to the rotor axis 134.

The cutting rotor 130 can be vertically lowered so that the cutting tools 132 initially contact the work surface 102 which may be referred to as a scratch point or touch point of the cutting rotor when the initial penetration of the cutting tools 132 into the un-milled surface 202 occurs. As the cutting rotor 130 is further directed vertically into and penetrates the work surface 102, the cutting tools 132 will fracture and break apart the material of the work surface 102 thereby forming the milled surface 204. The cutting rotor 130 can be lowered to into the work surface 102 until a desired cutting depth 206 is achieved. The cutting depth 206 is the difference between the un-milled surface 202 and the milled surface 204. The milling operation continues by directing the rotary mixer 100 and thus the cutting rotor 130 with respect to the travel axis 110 so that the cutting rotor continues to engage the work surface 102 and remove material. The cutting rotor 130 may be maintained at the cutting depth 206 during the milling operation and thereby form the desired milled surface 204.

As the cutting rotor 130 penetrates into the work surface 102, the cylindrical shape of the cutting rotor can create one or more lateral lines of contact where the cutting rotor interfaces with the work surface. Because of the arrangement of the cutting rotor 130 and the work surface 102, the lateral contact lines can extend generally parallel to the rotor axis 134 and generally perpendicular to the travel axis 110. There may be a number of lateral contact lines that occur during the milling operation and at different stages of the milling operation. For example, when the cutting rotor 130 initially contacts the work surface 102, a single lateral contact line may exist where the cutting rotor 130 and the un-milled surface 202 intersect. As the cutting rotor 130 is further lowered into the work surface 102, the cylindrical shape of the cutting rotor removes a circular segment of material of the work surface 102. The circular segment may be delineated by a secant or chord corresponding to the un-milled surface 202 and the cutting depth 206 corresponding to the depth of the segment.

As illustrated in FIG. 2, the milled segment may result in a first lateral contact line 210 and a second lateral contact line 212 where the curved shaped of the cutting rotor 130 has intersected the un-milled surface 202 of the work surface 102. In an embodiment, the lateral contact lines 210, 212 may be assessed when the cutting rotor 130 has reached the cutting depth 206. The first lateral contact line 210 can be associated with forward end 106 of the rotary mixer 100 and considered a forward lateral contact line and the second lateral contact line 212 can be associated with the rearward end 108 of the rotary mixer 100 and considered a rearward lateral contact lines. In other embodiments, the first and second lateral contact lines can be assessed at other locations where the cutting rotor 130 and the work surface 102 engage or intersect along other locations of the milled surface 204, for example, a third lateral contact line 214 can be considered to correspond to the milled surface 204 proximate the location of the cutting depth 206.

Figure 3:
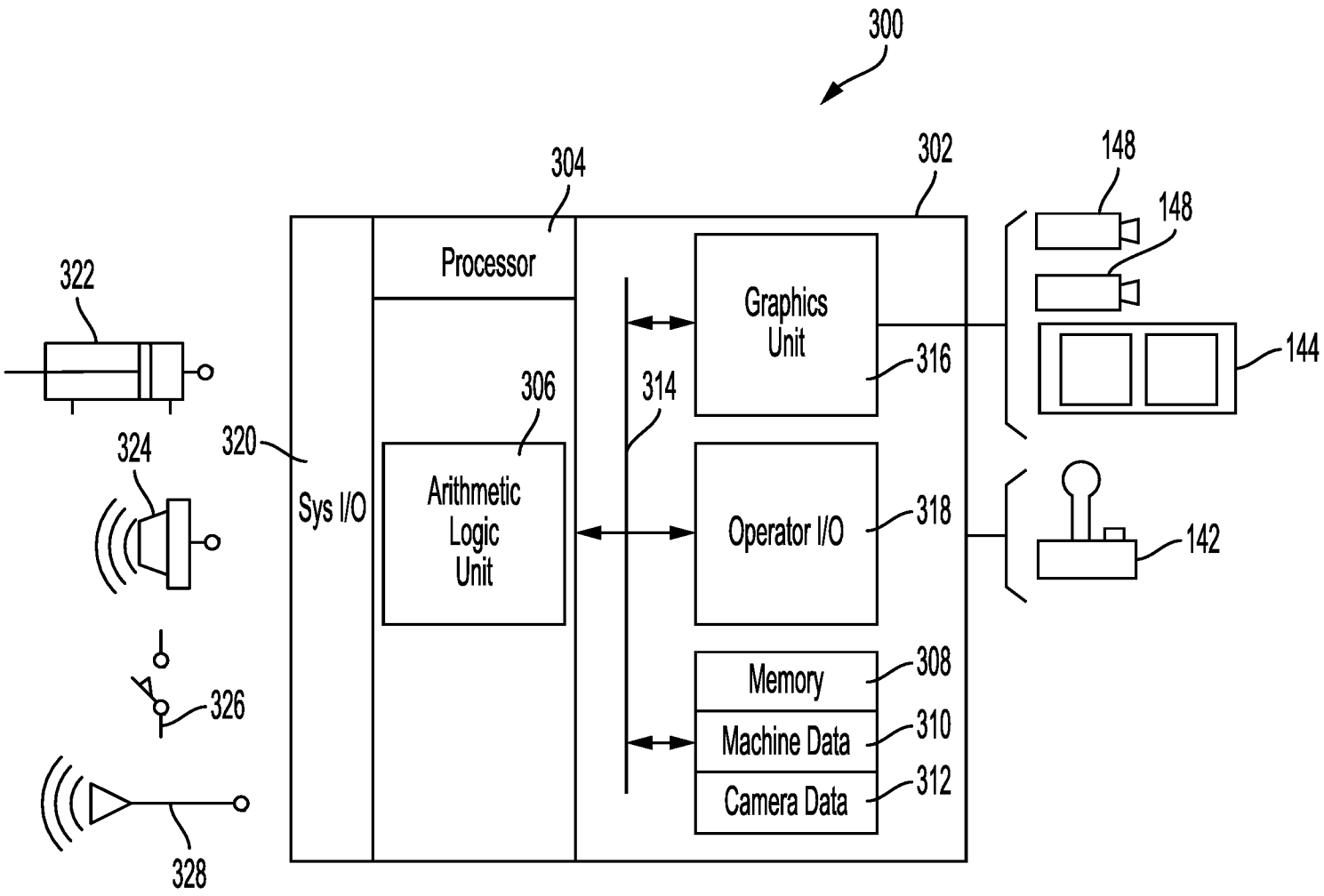
FIG. 3 is a schematic block diagram of a computer-implemented image augmentation system for assisting operation of the milling machine by augmenting the visual images captured by the plurality of cameras.

Because the cutting rotor 130 is accommodated in and visibly obstructed by the rotor enclosure 136, the operator is unable to view the first and second lateral contact lines 210, 212 during the milling operation. Therefore, to visually assist the milling operation, the rotary mixer 100 can be operatively associated with an image augmentation system 300 that functions in cooperation with the camera network 146 to generate an augmented image of the cutting rotor 130 with respect to the work surface 102. Referring to FIG. 3, the image augmentation system 300 can be implemented by an electronic controller 302, sometimes referred to as an electronic control module (ECM) or electronic control unit (ECU). The electronic controller 302 can be configured to conduct image processing of the visual images obtained by the camera 148 using an algorithm and computer executed operations.

To process electronic data and execute instructions, the electronic controller 302 can include one or more microprocessors 304 or similar circuitry like an application specific integrated circuit (ASIC) or a field programmable gate array. As explained below, the microprocessors 304 can include or be programmed to conduct specific logical functions, and can be configured with or associated with appropriate circuitry for such operation. The microprocessor 304 can be programmable to read and/or perform functions, steps, routines, data tables, and the like that are associated with the image augmentation system 300. For example, in an embodiment, the microprocessor 304 can include an arithmetic logic unit 306 which is specifically programmed or includes specific circuitry to perform mathematical operations and kinematic equations to facilitate the image augmentation system 300, although in other embodiments, the microprocessor may be a general purpose CPU.

To store the software instructions embodying the image augmentation system 300, the electronic controller 302 can include a system memory 308 or similar data storage. In various aspects, the system memory 308 can be readable, writable, or combinations thereof. To facilitate the image augmentation system 300, the system memory 308 may include electronically storable data related to geometric dimensions of the rotary mixer 100 and cutting rotor 130 (e.g., machine dimensional data 310) such as the diameter of the cutting rotor. The system memory 308 can also store electronic data related to the locations and position of the plurality of cameras 148 (e.g. camera data 312), including the angular extension of the field of view. The system memory 308 can communicate with the microprocessor 304 via a bus 314.

To communicate with the plurality of cameras 148 associated with the camera network 146, the electronic controller 302 can include a video module or graphics unit 316, such as a video card specifically configured for receiving, transmitting, and/or processing video and pictorial images. The graphics unit 316 can include processing and data storage capabilities dedicated to processing video specific data and can serve as the communication node between the electronic controller 302 and the cameras 148 and video display 144 on the rotor mixer 100. The graphics unit 316 can communicate with the microprocessor 304 via the bus 314, although in other embodiments, the functionality of graphics unit may be integrated with the microprocessor. The graphics unit 316 can send and receive electronic data signals with the cameras 148 and the video display 144 in the form of computer processable bits and bytes.

To obtain data regarding the milling operation, the electronic controller 302 can include an operator input/output (I/O) interface 318 that communicates with the operator controls such as the steering mechanism 142. The image augmentation system 300 may be thus informed of the travel direction of the rotary mixer 100 with respect to the travel axis 110 during the milling operation. The operator I/O interface 318 may communicate with other operator controls including, for example, controls associated with the cutting rotor (e.g., rotor speed) and the elevation mechanism (e.g., cutting depth).

To obtain other data regarding machine operation, the electronic controller 302 can include a system input/output (I/O) interface 320 that communicates with system settings and processes. For example, the system I/O interface 320 can communicate with sensors and controls associated with one or more hydraulic actuators 322 of the elevation mechanism used to adjust the vertical elevation of the rotary mixer 100 with respect to the work surface 102. To obtain other information regarding the milling operation, such as the relative positions and movement of the mechanisms and assemblies of the rotary mixer 100, the system I/O 320 can communicate with visual image sensors 324 sensitive to light and limit switches 326 or position sensors sensitive to relative positions of different movable elements. To communicate with one or more off board systems, the system I/O interface 320 can be associated with a transceiver 328 for sending and receiving radio signals.

Figure 4:
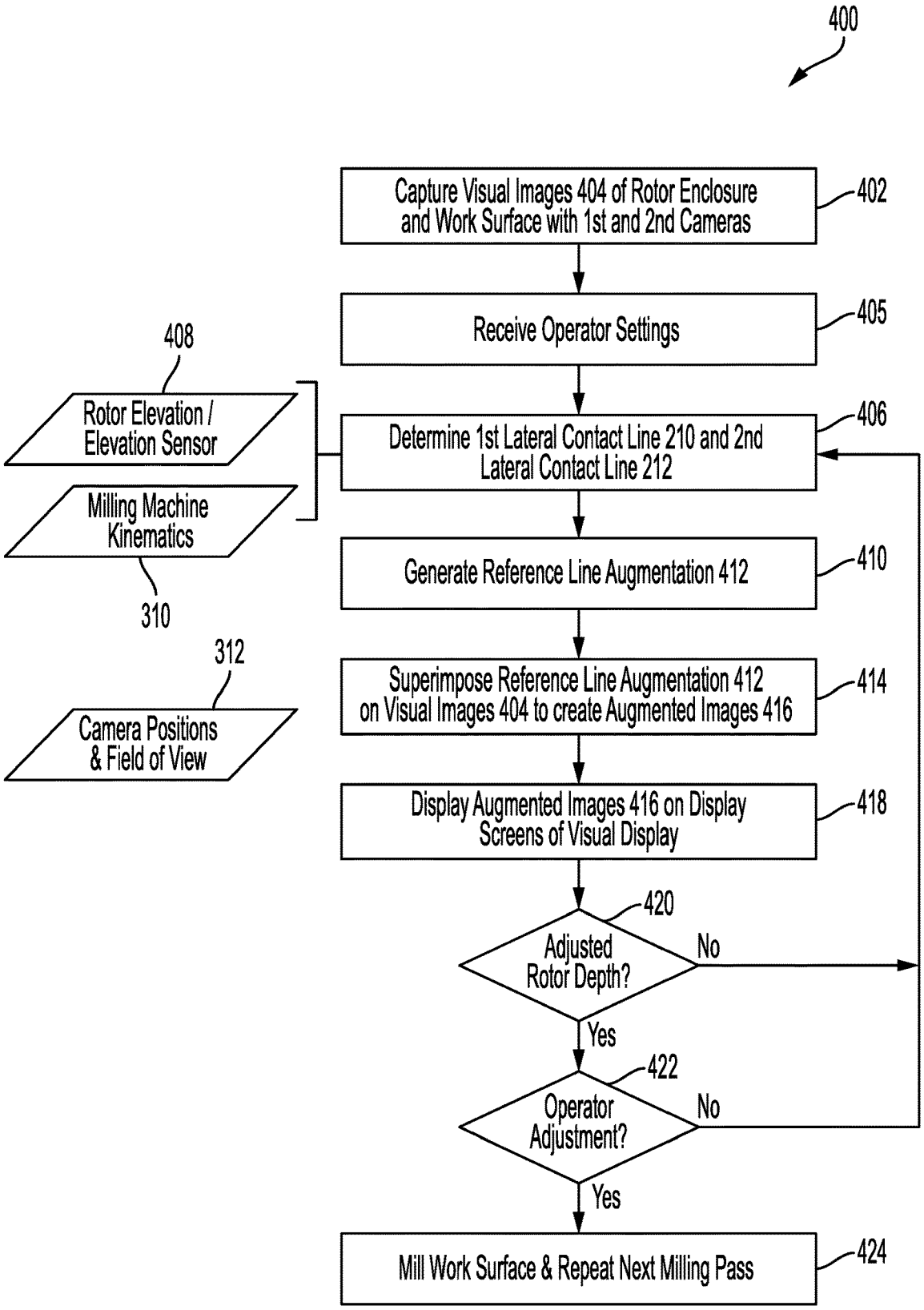
FIG. 4 is a flow diagram of a possible process for electronic implementation by the image augmentation system to capture, augment, and display a visual image to assist in a milling operation.

Referring to FIG. 4, there is illustrated an exemplary process 400 that may be performed by the image augmentation system 300 to generate augmented visual images to assist in the milling operation. The process 400 depicted in the flow diagram for accomplishing these tasks may include a series of steps or instructions implemented as non-transitory computer executable software code in the form of an application or program. The process 400 can begin with an image capturing step 402 in which a visual image 404 is captured by one or more cameras 148 associated with the camera network 146. In an embodiment, visual images 404 can be individually captured by the first camera 148 associated the first lateral side 112 of the rotary mixer 100 and by the second camera 148 associated with the second lateral side 114 of the rotary mixer 100. Because the field of view of the cameras 148 is oriented to include the rotor enclosure 136 including the enclosure sidewalls 138 and the work surface 102, both elements are included in the visual images 404. The visual images 404 may be captured in video form and processed as a real time or live feed.

As described above, there may be a number of lateral contact lines 210, 212 associated with a particular cut made during the milling operation depends upon the cutting depth and other factors. To enable the operator to tailor how the visual images 404 will be displayed, in an embodiment, the process 400 can include an operator setting step 405 in which the operator can input preferences as to how the image augmentation system 300 will generate and display an augmented image of the milling operation. For example, the operator setting step 405 may receive inputs regarding the number and/or arrangement of the lateral contact lines of interest, such as the number of lateral contact lines and the location of their point of contact between the cylindrical surface of the cutting rotor and the milled surface of the work surface, the color and line thickness of the reference line augmentation, etc.

In a line location determination step 406, the image augmentation system 300 can determine one or more lateral contact line 210, 212 where the cutting rotor 130 is physically contacting the work surface 102. The line location determination step 406 can conduct calculations based on various variables and parameters associated with the milling operation to determine the lateral contact line 210, 212. For example, the line location determination step 406 can receive electronic data representing the vertical rotor elevation 408 with respect to the work surface 102 from an elevation sensor operatively associated with the elevation mechanism. The elevation mechanism can be the lifting columns 118 coupling the frame 104 to the traction devices 116 or can be a separate mechanism that vertically adjusts the cutting rotor 130 with respect to the frame 104. The rotor elevation 408 can correspond to a set or desired cutting depth 206 indicative of the penetration of the cutting rotor 130 into the work surface 102. The line location determination step 406 can also receive the geometric machine dimensions from the machine dimensional data 310 stored in the system memory 308 of the electronic controller 302 including for example, the rotor diameter and the relative heights of the frame with respect to the work surface. Applying kinematic equations to these variables, the line location determination step 406 can calculate and resolve the intersection points of the cutting rotor 130 and the work surface 102 which correspond to the first lateral contact line 210 and the second lateral contact line 212.

In a generation step 410, the process 400 can generate a reference line augmentation 412 which may be one or more animated lines intended to represent the first and/or second lateral contact lines 210, 212. The reference line augmentation 412 may be a data file including the locations of the lateral contact lines as determined in the line location determination step 406. In a subsequent superimposition step 414, the process 400 can superimpose or overlay the reference line augmentation 412 over the visual images 404 obtained in the image capturing step 402. The superimposition step 414 creates one or more augmented images 416 with the reference line augmentation 412 superimposed on the visual image 404. In an embodiment, an augmented image 416 can be individually generated for the visual image 404 associated with the first lateral side 112 of the rotary mixer 100 and for the visual image 404 associated with the second lateral side 114 of the rotary mixer 100. The same reference line augmentation 412 which may include a plurality of lines in relation to each other can be superimposed over both visual images 404 to generate the augmented images.

The superimposition step 414 may be conducted by the electronic controller 302 associated with the image augmentation system 300 or, in an embodiment, the combination of the captured visual image 404 and the reference line augmentation 412 may be conducted by the visually display 144. For example, the visual image 404 may just be a live video feed transmitted to the visual display 144 that can separately receive and superimpose the reference line augmentation 412 on the visual image 404.

To determine where to dimensionally integrate the reference line augmentation 412 into the visual images 404, the superimposition step 414 can receive the camera data 312 stored in system memory 308 of the electronic controller 302. The superimposition step 414 can calculate the relative position of the reference line augmentation 412 on the visual images 404 from the camera position and/or field of view information included in the camera data 312. The functionality of the superimposition step 414 can be implemented by the arithmetic logic unit 306 of the microprocessor 304 or by the graphics unit 316.

The process 400 can include a display step 418 in which the augmented images 416 are displayed on the visual display 144 associated with the image augmentation system 300. For example, the graphics unit 316 can transfer data corresponding to the augmented images 416 to the visual display 144 as a digital image file. In other embodiments, the visual image 404 and the reference line augmentation 412 can be sent separately to the visual display 144 that can assemble and display the augmented image 416 including the reference line augmentation 412 to assist the operator during the milling operation by indicating the position of the first and/or second lateral contact lines 210, 212 associated with the cutting rotor 130 and work surface 102. The augmented images 416 enable the operator to visually perceive the interface between the cutting rotor 130 and the work surface 102 that is otherwise obscured by the rotor enclosure 136. In an embodiment, the process 400 can occur substantially in real time so the operator is presented with an augmented image showing the present position and relation of the cutting rotor 130 and the work surface 102.

In an embodiment, the process 400 may be configured to accommodate or adapt to various adjustments during the milling operation. For example, it may be desired to adjust the cutting depth, i.e. to increase or decrease the penetration of the cutting rotor 130 into the work surface 102. The process 400 can include a cutting depth query 420 which detects adjustments to the commanded cutting depth, for example, as input through the operator controls or as directed by a predetermined digital milling plan. In the event the cutting depth query 420 detects a commanded adjustment to the cutting depth, the process 400 can return to the line location determination step 406 to reobtain data regarding the rotor elevation and recalculate the first and second lateral contact lines 210, 212. The process 400 can thereafter proceed with the subsequent steps to generate and display a new augmented image.

In an embodiment, the process 400 can enable manual adjustments to the augmented image 416 to be made by the operator. For example, in an operator adjustment query 422, the process 400 can monitor for and adjust to operator adjustments to the augmented image. In an embodiment, the operator may adjust the locations of the reference line augmentation 412 imposed on the visual image 404 to account for specific circumstances. The operator may also adjust the focus or field of view of the cameras 148 using the pan-zoom-tilt controls. In the event the operator adjustment query 422 detects an operator commanded adjustment, the process 400 can return to the line location determination step 406 to reobtain any new data and perform any necessary recalculations, then proceed with the subsequent steps to generate and display a new augmented image 416. The process 400 can conclude with a milling operation 424 in which the rotary mixer 100 or similar machine mills the work surface 102 to fragment the material of the work surface 102.

INDUSTRIAL APPLICABILITY

Figure 5:
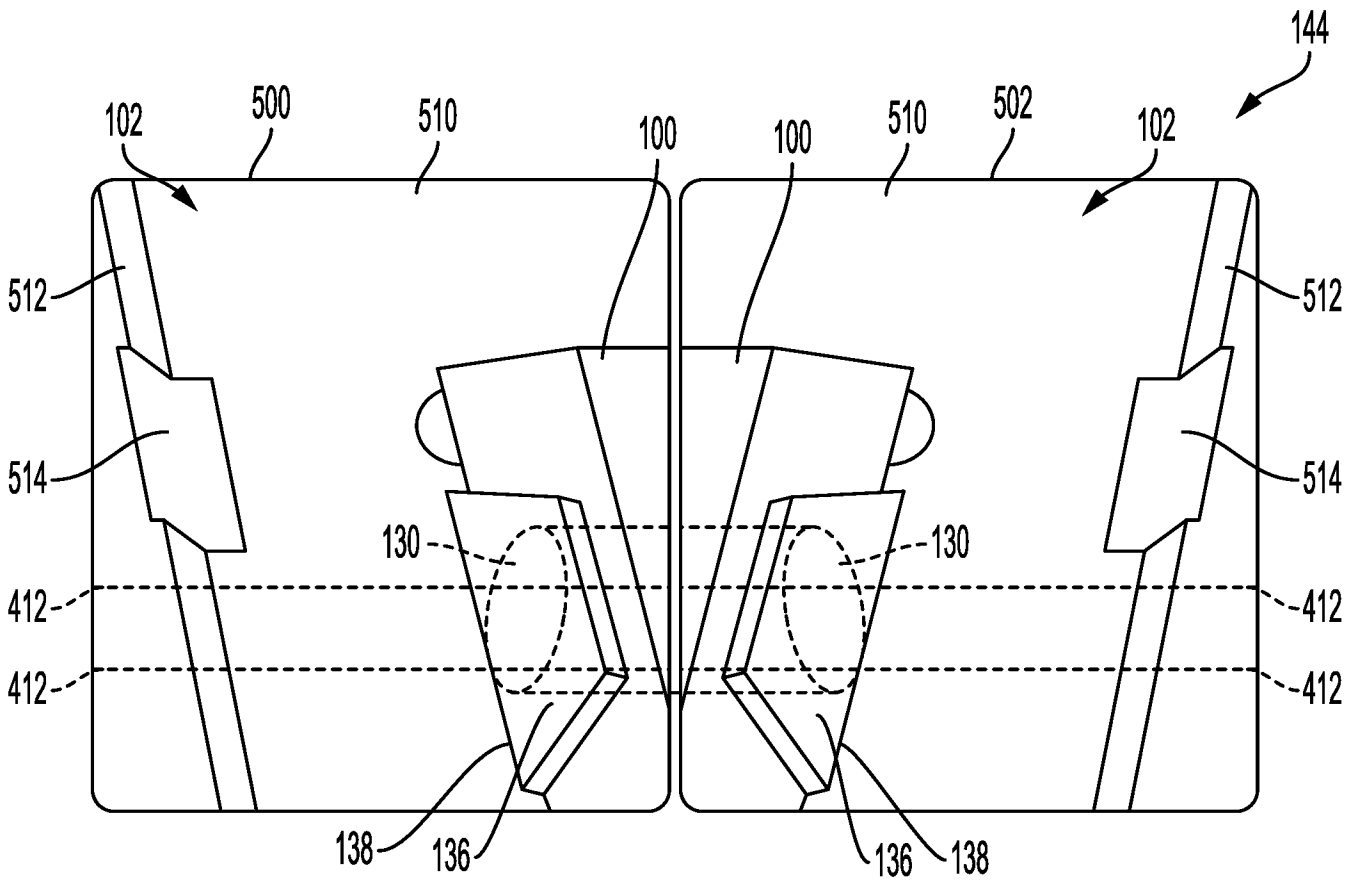
FIG. 5 is a representative visual display including first and second display screens displaying an augmented image in accordance with the disclosure.

Referring to FIG. 5, and in accordance with the prior figures, there is illustrated the visual display 144 associated with the rotary mixer 100 presenting an augmented image in pictorial form in accordance with the disclosure. The visual display 144 can be a liquid crystal display or similar flat panel technology that communicates with the electronic controller 302 associated with the image augmentation system 300 via an Ethernet connection, a video graphics display (VGA) connector, or similar conductive connectors and ports to the visual image as augmented by the image augmentation system 300. In other possible embodiments, the visual display 144 can be a cathode ray tube (CRT). To present augmented images associated with the first camera 148 associated with the first lateral side 112 and the second camera 148 associated with the second lateral side 114, the visual display 144 can have a dual screen configuration and can include a first display screen 500 and a second display screen 502 in a side-by-side arrangement. The first and second display screens 500, 502 can be distinct, independently operable screen units with individual casings. In another embodiment, the visual display 144 can be of a split screen configuration with the first and second display screens 500, 502 associated with separate but adjacent areas on the same display unit. In various embodiments, the visual display 144 can include different arrangements and numbers of display screens depending on the number of cameras 148 on the rotary mixer 100.

Because of the orientation and arrangement of the field of view 150 for the first and second cameras 148, the visual images 404 captured during the image capturing step 402 of the process 400 and can include part of the rotary mixer 100 including the rotor enclosure 136 with the enclosure sidewalls 138 and the work surface 102. The captured visual images 404 may be oriented forward with respect to the travel axis 110 and downward to capture the forward end 106 of the rotary mixer 100, although in other embodiments, the field of view of the cameras 148 may be directed rearward to capture the rearward end of the rotary mixer. In the illustrated embodiment, the work surface 102 may include a paved road 510, a raised curb 512 delineating an edge of the paved road 510, storm drains 514, and other common road features.

The field of view 150 and the focus of the first and second visual images 404 captured by the first and second cameras 148 respectively may be generally coextensive so that, when displayed on the first and second display screens 500, 502, the visual images align with respect to the travel axis 110. When presented in the side-by-side configuration on the first and second display screens 500, 502, the first and second visual images provide a coherent view of the first and second lateral sides 112, 114 of the rotary mixer 100. To indicate the location of the cutting rotor 130 and its engagement with the work surface 102, the first augmented image 416 on the first display screen 500 and the second augmented image 416 on the second display screen 502 each include the reference line augmentation 412, which may include one or more reference lines corresponding to the lateral contact lines 210, 212 between the cutting rotor and work surface. The reference line augmentation 412 on the first and second display screens 500, 502, which are parallel to the rotor axis 134, may align with each other (e.g. laterally across the visual display 144) to provide a continuous indication between the screens of the lateral contact lines 210, 212 of the cutting rotor 130 with respect to the work surface 102. In the embodiment, the reference line augmentation 412 is indicated as a dashed line that may, for example, be highlighted indication of the lateral contact surface, although in other embodiments the reference line augmentation may be indicated in other ways.

As described herein, the number and arrangement of lateral contact lines 210, 212 may be different for different degrees of the cutting depth 206. Accordingly, the reference line augmentation 412 may assume different forms depending on the milling operation and on the operator selections described above. For example, where the plane, slope or grade of the rotary mixer 100 is altered such the first lateral side 112 and second lateral side 114 are not of equal vertical heights, or where the shape of the work surface is uneven, the reference line augmentation 412 may skew towards or away from each other. In such a case, the lateral contact lines and the corresponding reference line augmentation may not be exactly parallel to the rotor axis or perpendicular to the travel axis.

In an embodiment, the visual display 144 may have touch screen capabilities or may be associated with other dials, knobs, or controls to allow the operator to adjust the reference line augmentation and the indicated lateral contact lines 210, 212. For example, the operator may use input gestures to change the lateral contact lines 210, 212 with respect to the curved circumferential surface of the cutting rotor 130 to tailor the augmented images 416 and the information presented therein. In addition, the operator may be able to adjust the field of view of the cameras 148, for example, by using pan-zoom-tilt controls. In such an event, the process 400 may recognize such adjustments and changes via the cutting depth query 420 and/or the operator adjustment query 422 and can recalculate to locations of the lateral contact lines 210, 212 and regenerate the augmented images 416.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A milling machine comprising:

a frame supported on a plurality of traction devices for travel along a work surface with respect to a travel axis, the frame defining a first lateral side and a second lateral side of the milling machine parallel with the travel axis of the milling machine;

a cutting rotor rotatably supported on the frame for milling a work surface, the cutting rotor shaped as a cylindrical drum defining a rotor axis perpendicular to the travel axis;

an rotor enclosure supported on the frame to accommodate the cutting rotor, the rotor enclosure including a first enclosure sidewall aligned with the first lateral side and a second enclosure sidewall aligned with the second lateral side;

a camera supported on the frame at the first lateral side in a location to capture a visual image of the rotor enclosure and the work surface; and an electronic controller being programmed to receive the visual image from the camera; receive data representing vertical rotor elevation; receive machine dimensional data including a rotor diameter; determine by kinematic equations positions for one or more lateral contact lines of the cutting rotor with respect to the work surface using the data representing vertical rotor elevation and the machine dimensional data, the lateral contact lines being generally perpendicular to the travel axis and generally parallel to the rotor axis; generate a reference line augmentation corresponding to the lateral contact lines; and superimpose the reference line augmentation on the visual image to create an augmented image.

2. The milling machine of claim 1, wherein the lateral contact lines include a forward lateral contact line oriented toward a forward end of the frame and a rearward lateral contact line oriented toward a rearward end of the frame.

3. The milling machine of claim 2, comprising a visual display operatively associated with the electronic controller to display the augmented image.

4. The milling machine of claim 3, comprising a second camera supported on the frame at the second lateral side in a location to capture a second visual image of the rotor enclosure and the work surface.

5. The milling machine of claim 4, wherein the electronic controller is configured to receive the second visual image from the second camera and superimpose the reference line augmentation on the second visual image to generate a second augmented image.

6. The milling machine of claim 5, wherein the visual display includes a second display screen and presents the second augmented image on the second display screen.

7. The milling machine of claim 1, comprising an elevation mechanism for vertically adjusting elevation of the cutting rotor with respect to the work surface and an elevation sensor for sensing a rotor elevation with respect to the work surface.

8. The milling machine of claim 7, wherein the electronic controller is configured to receive the rotor elevation from the elevation sensor and to adjust the lateral contact lines based on the rotor elevation.

9. The milling machine of claim 1, wherein the electronic controller is programmed to enable selection of a number and an arrangement of the lateral contact lines used to generate the reference line augmentation.

10. The milling machine of claim 1, wherein the visual image is video.

11. A method of operating a milling machine comprising:

capturing a visual image of a lateral side of a rotor enclosure of the milling machine and a work surface to be milled by a cutting rotor accommodated in the rotor enclosure;

receiving data representing vertical rotor elevation;

receiving machine dimensional data including a rotor diameter;

determining by kinematic equations one or more lateral contact lines where the cutting rotor will contact the work surface using the data representing vertical rotor elevation and the machine dimensional data;

generating a reference line augmentation corresponding to the lateral contact lines;

superimposing the reference line augmentation on the visual image to create an augmented image; and displaying the augmented image on a visual display associated with the milling machine.

12. The method of claim 11, comprising capturing a second visual image of a second lateral side of the rotor enclosure of the milling machine and superimposing the reference line augmentation on the second visual image to create a second augmented image.

13. The method of claim 12, comprising displaying the second augmented image in a side-by-side relation to the augmented image.

14. The method of claim 13, wherein the lateral contact lines are perpendicular to a travel axis of the milling machine and parallel to a rotor axis of the cutting rotor.

15. The method of claim 14, comprising receiving a rotor elevation with respect to the work surface and adjusting the lateral contact lines based on the rotor elevation.

16. The method of claim 15, comprising receiving operator settings indicative of a number and an arrangement of the lateral contact lines used to generate the augmented image.

* * * * *